US009250551B2

(12) United States Patent
Ojima et al.

(10) Patent No.: US 9,250,551 B2
(45) Date of Patent: Feb. 2, 2016

(54) METHOD FOR MANUFACTURING ELECTROSTATIC LATENT IMAGE DEVELOPING TONER

(71) Applicant: KYOCERA Document Solutions Inc., Osaka (JP)

(72) Inventors: Seishi Ojima, Osaka (JP); Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/229,120

(22) Filed: Mar. 28, 2014

(65) Prior Publication Data

US 2014/0295345 A1 Oct. 2, 2014

(30) Foreign Application Priority Data

Mar. 29, 2013 (JP) ..... 2013-074773

(51) Int. Cl.
*G03G 9/093* (2006.01)

(52) U.S. Cl.
CPC ..... *G03G 9/09392* (2013.01); *G03G 9/09321* (2013.01); *G03G 9/09328* (2013.01)

(58) Field of Classification Search
CPC ..... G03G 9/09392; G03G 9/09314; G03G 9/09321; G03G 9/09328
USPC ..... 430/137.11, 110.2
See application file for complete search history.

(56) References Cited

U.S. PATENT DOCUMENTS

| | | | | |
|---|---|---|---|---|
| 5,141,833 | A * | 8/1992 | Kitamori et al. | 430/122.5 |
| 7,960,085 | B2 * | 6/2011 | Kawamura et al. | 430/137.11 |
| 2010/0159386 | A1 | 6/2010 | Urabe et al. | |
| 2014/0065536 | A1 * | 3/2014 | Kikushima | 430/110.2 |

FOREIGN PATENT DOCUMENTS

| | | | |
|---|---|---|---|
| JP | 2005-234083 | A | 9/2005 |
| JP | 2008-052021 | A | 3/2008 |
| JP | 2011-028150 | A | 2/2011 |
| JP | 2011-128574 | A | 6/2011 |

OTHER PUBLICATIONS

European Patent Office Espacenet machine-assisted English-language translation of JP 2008-052021 (pub. Mar. 2008).*
Neufeldt, V., et al., ed., Webster's New World Dictionary, Third College Edition, Simon & Schuster, Inc., NY (1988), p. 869.*
Grot, Walther, Fluorinated Ionomers, Plastics Design Library, William Andrew Publishing, NY (2008), retrieved from www.knovel.com, pp. 24-26.*
An Office Action; "Notice of Reasons for Rejection," issued by the Japanese Patent Office on May 19, 2015, which corresponds to Japanese Patent Application No. 2013-074773 and is related to U.S. Appl. No. 14/229,120.

* cited by examiner

*Primary Examiner* — Janis L Dote
(74) *Attorney, Agent, or Firm* — Studebaker & Brackett PC

(57) ABSTRACT

An electrostatic latent image developing toner is manufactured by mixing an aqueous medium dispersion liquid (X) containing negatively chargeable toner cores and an aqueous medium dispersion liquid (Y) containing positively chargeable resin particulates, followed by stirring the mixture liquid to form shell layers each on a surface of the toner cores with the resin particulates. The shell layers are formed with the resin particulates subjected to a stirring treatment together with an anionic surfactant.

6 Claims, 1 Drawing Sheet

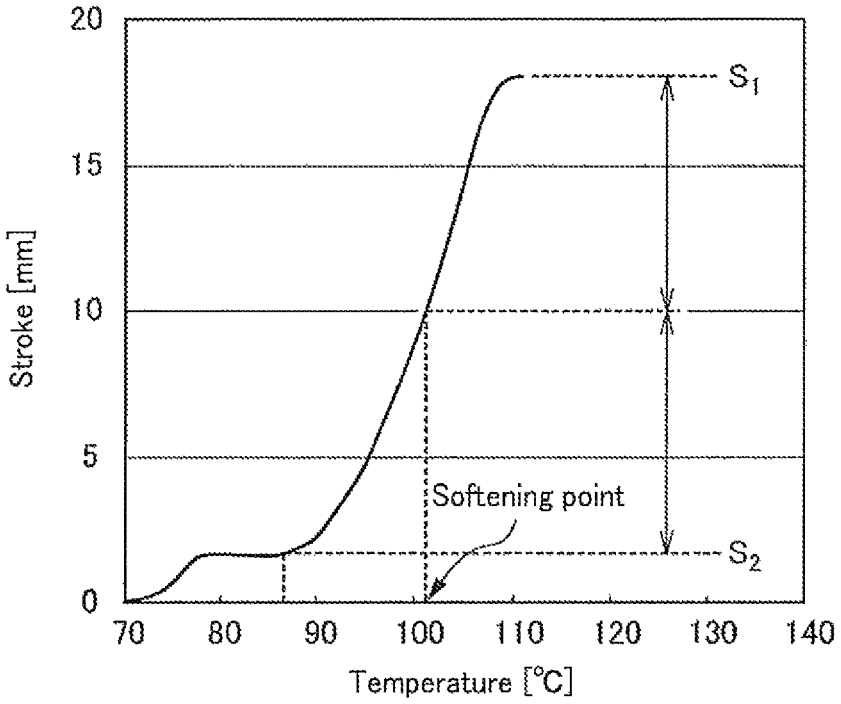
20
15
10
5
0
Stroke [mm]
70
80
90
100
110
120
130
140
Temperature [°C]
S1
S2
Softening point

METHOD FOR MANUFACTURING ELECTROSTATIC LATENT IMAGE DEVELOPING TONER

INCORPORATION BY REFERENCE

The present application claims priority under 35 U.S.C. §119 to Japanese Patent Application No. 2013-074773, filed Mar. 29, 2013. The contents of this application are incorporated herein by reference in their entirety.

BACKGROUND

The present disclosure relates to methods for manufacturing an electrostatic latent image developing toner.

For the purpose of enhancing the quality of images to be formed, recent demands for toner are to reduce the average particle size of toner particles thereby to increase the resolution. To output images of high quality, it is effective to reduce an average particle size of toner and to ensure that the particle size distribution of the toner is sharp.

For manufacturing toner having a small average particle size and a sharp particle size distribution, one known method involves a process of preparing a dispersion liquid containing particulates and a process of forming aggregated particulates. In this method, the process of preparing the dispersion liquid involves application of a mechanical shear force to a particle-like mixture containing a binder resin and a colorant in an aqueous medium. As a result, the dispersion liquid containing particulates is prepared. The process of forming aggregated particulates involves adjusting the pH of the dispersion liquid to cause the particulates contained in the dispersion liquid to aggregate. When the pH of the dispersion liquid is 7, the volume average particle size of the particulates contained in the dispersion liquid is 2 μm or less, and when the zeta-potential of the particulates is −30 mV, the pH of the dispersion liquid is 3.0 or more and 6.9 or less.

In another known method that is based on the above-described method, the process of forming the aggregated particulates involves adding a dispersion liquid that additionally contains particulates containing resin. With such a method, shell layers are formed each on the surface of aggregated particulates with the particulates containing the resin, so that a toner having a core-shell structure is obtained.

SUMMARY

The present disclosure relates to a method for manufacturing an electrostatic latent image developing toner. The manufacturing method involves mixing an aqueous medium dispersion liquid (X) and an aqueous medium dispersion liquid (Y), followed by stirring the mixture liquid, and forming shell layers each on a surface of toner cores with resin particulates. The aqueous medium dispersion liquid (X) contains the negatively chargeable toner cores. The aqueous medium dispersion liquid (Y) contains the positively chargeable resin particulates. Each shell layer is formed by covering the surface of one of the toner cores with the resin particulates subjected to a stirring treatment together with an anionic surfactant.

BRIEF DESCRIPTION OF THE DRAWINGS

FIG. 1 is a diagram describing a method for measuring a softening point by using an elevated flow tester.

DETAILED DESCRIPTION

The following describes an embodiment of the present disclosure. However, the present disclosure is in no way limited to the embodiment described below, and appropriate modifications may be made within the scope of the object of the present disclosure. It should be noted that for the points where descriptions are overlapped, there may be cases where the description is omitted where appropriate, which, however, does not limit the content of the disclosure.

In a method for manufacturing an electrostatic latent image developing toner according to the present disclosure, a aqueous medium dispersion liquid (X) containing negatively chargeable toner cores and an aqueous medium dispersion liquid (Y) containing positively chargeable resin particulates are mixed, followed by stirring the resulting mixture liquid to form shell layers each on the surface of particulate particle-like toner cores with the resin particulates. Each shell layer is formed by covering a toner core with the resin particulates having been subjected to a stirring treatment together with an anionic surfactant. The following sequentially describes toner materials used in the method for manufacturing the electrostatic latent image developing toner and the method for manufacturing the electrostatic latent image developing toner.

<<Toner Materials>>

In the method for manufacturing the electrostatic latent image developing toner (hereinafter, may also be referred to as "toner") according to the present disclosure, the toner contains a plurality of toner particles. The plurality of toner particles each include a negatively chargeable toner core and a shell layer covering the surface of the negatively chargeable toner core. The negatively chargeable toner core contains a binder resin and one or more optional components (such as a colorant, a mold releasing agent, a charge control agent, and a magnetic powder) as needed. The shell layer is made from positively chargeable resin particulates. The toner obtained by the manufacturing method according to the present disclosure may further contain an external additive on the surface of each shell layers. The toner obtained by the manufacturing method according to the present disclosure can be mixed with a carrier as needed and thus used as a two-component developer. The following sequentially describes the toner core, the shell layer, the external additive, and the carrier used for using the toner obtained by the manufacturing method according to the present disclosure as a two-component developer.

[Toner Core]

The method for manufacturing the toner according to the present disclosure uses negatively chargeable particle-like toner cores and positively chargeable resin particulates. When the negatively chargeable toner cores are dispersed in water, the toner cores will have a negative zeta-potential. When the positively chargeable resin particulates are dispersed in water, the resin particulates will have a positive zeta-potential.

The polarity of the zeta-potential of the toner cores is determined by the materials constituting the toner cores. For the toner cores to have a negative zeta-potential in water, adding to the toner cores a material containing negatively chargeable functional groups, such as carboxyl groups or sulfonate groups, will suffice. As a material containing negatively chargeable functional groups, a binder resin, which will be described later, is typically used. The zeta-potential of a dispersion liquid can be measured by using a measuring device, such as an ultrasonic measuring device for the zeta potential and the particle size distribution ("DT-1200" manufactured by Dispersion Technology Inc.).

The toner cores may contain one or more optional components (such as a colorant, a mold releasing agent, a charge control agent, and a magnetic powder) in the binder resin as needed. The following sequentially describes the binder resin, the colorant, the mold releasing agent, the charge control agent, and the magnetic powder, which are the components contained in the toner cores.

[Binder Resin]

The type of the binder resin is not particularly limited as long as negatively chargeable toner cores can be prepared. Examples of the binder resin include thermoplastic resins (such as styrene-based resins, (meth)acrylic resins, styrene-(meth)acrylic resins, polyethylene-based resins, polypropylene-based resins, vinyl chloride-based resins, polyester resins, polyamide resins, polyurethane resins, polyvinyl alcohol-based resins, vinyl ether-based resins, N-vinyl-based resins, and styrene-butadiene resins). For the binder resins, the resins having acidic groups (such as carboxyl groups or sulfonic acid groups) at a part of a molecular chain (at an end or side chain) are preferred as they readily allow preparation of negatively chargeable toner cores. Examples of such resins having the acidic groups include (meth)acrylic resins, styrene-(meth)acrylic resins, and polyester resins. For the resins having such acidic groups, polyester resins are preferred as they readily allow preparation of toner having excellent low-temperature fixability and excellent color formability.

When the binder resin contains acidic groups, the acid value of the binder resin is preferably 5 mgKOH/g or more and 40 mgKOH/g or less. The acid value of the binder resin that is too low is not favorable for the following reason. That is, depending on the composition subjected to the aggregation, the particulates may not sufficiently aggregate when the aqueous medium dispersion liquid containing the toner cores is prepared by using the aggregation method, which will be described later. On the other hand, the acid value of the binder resin that is too high is not favorable in that the toner manufactured by using such a resin will have some properties impaired by the humidity under high-humidity conditions.

The following sequentially describes (meth)acrylic resins, styrene-(meth)acrylic resins, and polyester resins all of which are preferred binder resins.

<(Meth)Acrylic Resin>

First, (meth)acrylic resins are obtained by copolymerizing monomers at least containing (meth)acrylic monomers. The content of units each derived from (meth)acrylic monomers in (meth)acrylic resins is preferably 70% by mass or more, more preferably 80% by mass or more, particularly preferably 90% by mass or more, and most preferably 100% by mass.

Examples of the (meth)acrylic monomers used for preparing the (meth)acrylic resins include (meth)acrylic acid, alkyl (meth)acrylates (such as methyl(meth)acrylate, ethyl(meth) acrylate, and propyl(meth)acrylate), and (meth)acrylamide compounds (such as (meth)acrylamide, N-alkyl(meth)acrylamides, N-aryl(meth)acrylamides, N,N-dialkyl(meth)acrylamides, and N,N-diaryl(meth)acrylamides). Preferably, the (meth)acrylic resin contains, as the acidic groups, carboxyl groups each contained in a unit derived from (meth)acrylic acid. In this case, the acid value of the (meth)acrylic resin can be adjusted by increasing or decreasing the amount of (meth) acrylic acid used to prepare the (meth)acrylic resin.

In the case where the (meth)acrylic resin is obtained by copolymerizing (meth)acrylic monomers with monomers other than the (meth)acrylic monomers, examples of such other monomers include olefins (such as ethylene, propylene, butene-1, pentene-1, hexene-1, heptene-1, and octene-1), allyl esters (such as allyl acetate, allyl benzoate, allyl acetoacetate, and allyl lactate), vinyl ethers (such as hexylvinyl ether, octylvinyl ether, ethylhexyl vinyl ether, methoxyethyl vinyl ether, ethoxyethyl vinyl ether, chloroethyl vinyl ether, 2-ethylbutyl vinyl ether, dimethylaminoethyl vinyl ether, diethylaminoethyl vinyl ether, benzyl vinyl ether, vinyl phenyl ether, vinyl tolyl ether, vinyl chlorophenyl ether, vinyl-2,4-dichlorophenyl ether, and vinyl naphthyl ether), and vinyl esters (such as vinyl acetate, vinyl propionate, vinyl butyrate, vinyl isobutyrate, vinyl diethyl acetate, vinyl chloroacetate, vinyl methoxy acetate, vinyl butoxy acetate, vinyl phenyl acetate, vinyl acetoacetate, vinyl lactate, vinyl benzoate, vinyl salicylate, vinyl chlorobenzoate, and vinyl naphthoate).

<Styrene-(Meth)Acrylic Resin>

The styrene-(meth)acrylic resins are obtained by copolymerizing monomers at least containing styrene-based monomers and (meth)acrylic monomers. The total content of a unit derived from a styrene-based monomer and a unit derived from a (meth)acrylic monomer in the styrene-(meth)acrylic resin is preferably 70% by mass or more, more preferably 80% by mass or more, particularly preferably 90% by mass or more, and most preferably 100% by mass.

Examples of the styrene-based monomers used to prepare the styrene-(meth)acrylic resin include styrene, α-methylstyrene, o-methylstyrene, m-methylstyrene, p-methylstyrene, p-ethylstyrene, 2,4-dimethyl styrene, p-n-butylstyrene, p-dodecylstyrene, p-methoxystyrene, p-phenylstyrene, and p-chlorostyrene.

The (meth)acrylic monomers used to prepare the styrene-(meth)acrylic resin are the same as those used to prepare the (meth)acrylic resin.

Preferably, the styrene-(meth)acrylic resin contains, as acidic groups, carboxyl groups each contained in a unit derived from (meth)acrylic acid. In this case, the acid value of the styrene-(meth)acrylic resin can be adjusted by increasing or decreasing the amount of (meth)acrylic acid used to prepare the styrene-(meth)acrylic resin.

In one example, the styrene-(meth)acrylic resin may be a resin obtained by copolymerizing styrene-based monomers with (meth)acrylic monomers. Alternatively, monomers other than either of the styrene-based monomers and the (meth)acrylic monomers may be additionally involved in the copolymerization. Examples of such other monomers are the same as those mentioned as the other monomers other than the (meth)acrylic monomers in the description given for the (meth)acrylic resin.

<Polyester Resin>

As the polyester resin, a resin obtained through condensation polymerization or condensation copolymerization of a dihydric or tri- or higher-hydric alcohol component with a dicarboxylic or tri- or higher-carboxylic acid component may be used. Examples of the components used to synthesize the polyester resin include the dihydric or tri- or higher-hydric alcohol components and the dicarboxylic or tri- or higher-carboxylic acid components shown below.

Examples of the dihydric alcohol components include diols (such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol), and bisphenols (such as bisphenol A, hydrogenated bisphenol A, polyoxyethylenated bisphenol A, and polyoxypropylenated bisphenol A). Examples of the tri- or higher-hydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the dicarboxylic acid components include: maleic acid; fumaric acid; citraconic acid; itaconic acid;

glutaconic acid; phthalic acid; isophthalic acid; terephthalic acid; cyclohexanedicarboxylic acid; succinic acid; adipic acid; sebacic acid; azelaic acid; 1,10-decanedicarboxylic acid; malonic acid; and alkyl succinic acid or alkenyl succinic acid (such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid). Examples of the tri- or higher-carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. These dicarboxylic or tri- or higher-carboxylic acid components may be used as ester-forming derivatives, such as acid halides, acid anhydrides, and lower alkyl esters. The term "lower alkyl" used herein refers to an alkyl group having 1 to 6 carbon atoms.

The acid value of the polyester resin can be adjusted by adjusting the balance between the functional groups that are hydroxyl groups and carboxylic groups respectively contained in the alcohol component and the carboxylic acid component used to synthesize the polyester resin.

The glass transition point (Tg) of the binder resin is preferably 30° C. or more and 60° C. or less. If Tg of the binder resin is too low, the toner particles may melt to stick together when the toner is washed and dried. On the other hand, if Tg of the binder resin is too high, the temperature needs to be higher for causing particulates containing the binder resin to aggregate, which increases the energy needed for the aggregation.

(Glass Transition Point (Tg) Measuring Method)

The glass transition point of the binder resin can be determined by using a measuring method compliant with JIS K7121. More specifically, the glass transition point of the binder resin can be determined by measuring an endothermic curve of the binder resin by using, as a measuring device, a differential scanning calorimeter ("DSC-6200" manufactured by Seiko Instruments Inc.). In the measurement, 10 mg of a measurement sample is placed into an aluminum pan, and an empty aluminum pan is used as a reference. Then, the measurement is carried out under the normal temperature and humidity conditions with a heating rate of 10° C./minute and a measurement temperature range of 25° C. to 200° C. both inclusive. From the thus measured endothermic curve of the binder resin, the glass transition point of the binder resin can be determined The softening point (Tm) of the binder resin is preferably 80° C. or more and 150° C. or less, and more preferably 90° C. or more and 140° C. or less. If the softening point of the binder resin is too high, the toner may not be sufficiently fixed to a recording medium at low temperatures. On the other hand, if the softening point of the binder resin is too low, the resin particulates tend to embedded in the toner cores in (II) Shell Layer Forming Process of the toner manufacturing method, which will be described later. With the resin particulates tending to be embedded in the toner cores, the toner may aggregate during high-temperature preservation, which may cause a decrease in heat-resistant preservability of the toner. The softening point of the binder resin can be measured by following the method below.

(Softening Point Measuring Method)

The softening point of the binder resin is measured by using an elevated flow tester (such as "CFT-500D" manufactured by Shimadzu Corporation). The measurement is performed by using 1.5 g of the toner as a sample with a die having a height of 1.0 mm and a diameter of 1.0 mm under the conditions: a heating rate of 4° C./minute; a pre-heat time of 300 seconds; a load of 5 kg; and a measurement temperature range of 60° C. to 200° C. both inclusive. The softening point of the binder resin is read from the S-curve regarding the temperature (° C.) and the stroke (mm) obtained by the measurement using the flow tester.

How to read the softening point of the binder resin is described with reference to FIG. 1. A maximum value of the stroke is denoted by $S_1$, and a stroke value of a base line at a low temperature side is denoted by $S_2$. The temperature at which the value of the stroke is equal to $(S_1+S_2)/2$ on the S-curve is determined as the softening point of the measurement sample.

The number average molecular weight (Mn) of the binder resin is preferably 2,000 or more and 20,000 or less. In addition, a molecular weight distribution (Mw/Mn) of the binder resin represented by the ratio of the mass average molecular weight (Mw) to the number average molecular weight (Mn) is preferably 2 or more and 60 or less, and more preferably 2 or more and 10 or less. By setting the molecular weight distribution of the binder resin to fall within in such a range described above, a sharp particle size distribution of the aggregated particulates is likely to be ensured. The number average molecular weight (Mn) and the mass average molecular weight (Mw) of the binder resin can be measured by using gel permeation chromatography.

[Colorant]

A known colorant can be used. Specific examples of preferred colorants include the following.

For yellow colorants, the examples include condensed azo compounds, isoindolinone compounds, anthraquinone compounds, azo-metal complexes, methine compounds, and allylamide compounds. Specifically, the examples include C.I. pigment yellows (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. Vat yellow.

For magenta colorants, the examples include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specifically, the examples include C.I. pigment reds (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

For cyan colorants, the examples include copper phthalocyanine compounds, copper phthalocyanine derivatives, anthraquinone compounds, and basic dye lake compounds. Specifically, the examples include C.I. pigment blues (1, 7, 15, 15:1, 15:2, 15:3, 15:4, 60, 62, and 66), phthalocyanine blue, C.I. Vat blue, and C.I. acid blue.

The amount of the colorant used is preferably 1 part by mass or more and 30 parts by mass or less with respect to 100 parts by mass of the binder resin.

[Releasing Agent]

The releasing agent is used to improve the toner in its fixability to paper and offset resistance. The type of the releasing agent is not particularly limited as long as it is usable for a known toner.

Examples of preferred releasing agents include aliphatic hydrocarbon waxes (such as low molecular weight polyethylene, low molecular weight polypropylene, polyolefin copolymers, polyolefin waxes, microcrystalline waxes, paraffin waxes, and Fischer-Tropsch waxes), oxides of aliphatic hydrocarbon waxes (such as oxidized polyethylene waxes, and block copolymers of oxidized polyethylene waxes), plant waxes (such as candelilla wax, carnauba wax, Japan wax, jojoba wax, and rice wax), animal waxes (such as beeswax, lanolin, and spermaceti), mineral waxes (such as ozokerite, ceresin, and petrolatum), waxes containing a fatty acid ester as a major component (such as montanic acid ester wax, and castor wax), and waxes containing partially or fully deoxidized fatty acid esters (such as deoxidized carnauba wax).

The amount of the releasing agent used is preferably 0.1 parts by mass or more and 30 parts by mass or less with respect to 100 parts by mass of the binder resin, and more preferably 5 parts by mass or more and 20 parts by mass or less.

[Charge Control Agent]

The toner core may contain a charge control agent as needed. The charge control agent is used in an amount within such a range that the toner cores dispersed in water will have a negative zeta-potential. The charge control agent is used to improve the charge level stability or the charging startup characteristics of the toner, so that the toner having excellent durability or stability is obtained. The charging startup characteristics serve as an index indicating whether or not the toner can be charged to a predetermined charge level within a short time. In the case of positively charging the toner for performing the development, a positively chargeable charge control agent is used. On the other hand, in the case of negatively charging the toner for performing the development, a negatively chargeable charge control agent is used.

Examples of the positively chargeable charge control agent include azine compounds (such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline), direct dyes made of an azine compound (such as azine fast red FC, azine fast red 12BK, azine violet BO, azine brown 3G, azine light brown GR, azine dark green BH/C, azine deep black EW, and azine deep black 3RL), nigrosine compounds (such as nigrosine, nigrosine salts, and nigrosine derivatives), acid dyes made of a nigrosine compound (such as nigrosine BK, nigrosine NB, and nigrosine Z), metal salts (such as metal salts of naphthenic acids, and metal salts of higher fatty acids), alkoxylated amines, alkylamides, and quaternary ammonium salts (such as benzylmethylhexyldecyl ammonium and decyltrimethyl ammonium chloride). Among these positively chargeable charge control agents, the nigrosine compounds are preferred in that the resulting toner will have quicker charging startup characteristics. These positively chargeable charge control agents may be used singly or two or more types may be used in combination.

Resins including a quaternary ammonium salt, a carboxylate salt, or a carboxyl group as a functional group are also usable as the positively chargeable charge control agent. More specifically, the examples include styrene-based resins having a quaternary ammonium salt, acrylic resins having a quaternary ammonium salt, styrene-acrylic resins having a quaternary ammonium salt, polyester resins having a quaternary ammonium salt, styrene-based resins having a carboxylic acid salt, acrylic resins having a carboxylic acid salt, styrene-acrylic resins having a carboxylic acid salt, polyester resins having a carboxylic acid salt, styrene-based resins having a carboxyl group, acrylic resins having a carboxyl group, styrene-acrylic resins having a carboxyl group, and polyester resins having a carboxyl group. These resins may be oligomers having a relatively low molecular weight or polymers having a molecular weight of 10,000 or more.

Examples of the negatively chargeable charge control agents include organic metal complexes or chelate compounds. Preferred examples of organic metal complexes and chelate compounds include: metal acetylacetonate complexes such as aluminum acetylacetonate and iron (II) acetylacetonate; and salicylic acid-based metal complexes or salicylic acid-based metal salt such as 3,5-di-tert-butylsalicylic acid chromium. Of these examples, the salicylic acid-based metal complexes and the salicylic acid-based metal salts are more preferred. These negatively chargeable charge control agents may be used singly or two or more types may be used in combination.

The amount of the positively or negatively chargeable charge control agent used is preferably 1.5 parts by mass or more and 15 parts by mass or less with respect to 100 parts by mass of the toner, more preferably 2.0 parts by mass or more and 8.0 parts by mass or less, and particularly preferably 3.0 parts by mass or more and 7.0 parts by mass or less.

[Magnetic Powder]

Preferred examples of magnetic powders include: iron, such as ferrite and magnetite; ferromagnetic metals, such as cobalt and nickel; alloys containing iron and/or ferromagnetic metal; compounds containing iron and/or ferromagnetic metal; ferromagnetic alloys subjected to ferromagnetization, such as a thermal treatment; and chromium dioxide.

The average particle size of the magnetic powder is preferably 0.1 μm or more and 1.0 μm or less, and more preferably 0.1 μm or more and 0.5 μm or less. With the magnetic powder having an average particle size falling within such a range, uniform dispersion of the magnetic powder in the resin is likely to be achieved.

For the use of the toner as a one-component developer, the amount of the magnetic powder used is preferably 35 parts by mass or more and 60 parts by mass or less with respect to 100 parts by mass of the toner, more preferably 40 parts by mass or more and 60 parts by mass or less. For the use of the toner as a two-component developer, the amount of the magnetic powder used is preferably 20 parts by mass or less with respect to 100 parts by mass of the toner, and more preferably 15 parts by mass or less.

[Shell Layer]

The toner manufactured by the manufacturing method according to the present disclosure contains shell layers each formed on the surface of the toner cores and each containing positively chargeable resin particulates. As described above, when the positively chargeable resin particulates are dispersed in water, the resin particulates will have positive zeta-potential. The polarity of the zeta-potential of the resin particulates is determined by the materials constituting the resin particulates. For the resin particulates to have a positive zeta-potential in water, the resin particulates should contain positively chargeable functional groups such as quaternary ammonium salt functional groups. The positively chargeable resin particulates are prepared by forming, into particulates, a resin containing positively chargeable functional groups or a resin composition containing a positively chargeable charge control agent. For the resin constituting the resin particulates, polymers of monomers having unsaturated bonds are preferred in that it is made easier to prepare the particulates with a sharp particle size distribution and to form high-strength shell layers.

For the materials constituting the rein particulates, resins having positively chargeable functional groups are preferred, and resins that are polymers of monomers having positively chargeable functional groups and unsaturated bonds are more preferred. Preferred examples of the reins that are polymers of monomers having the positively chargeable functional groups and the unsaturated bonds include styrene-based resins having a quaternary ammonium salt, acrylic resins having a quaternary ammonium salt, styrene-acrylic resins having a quaternary ammonium salt, and polyester resins having a quaternary ammonium salt, all of which are listed above as the resins usable as the positively chargeable charge control agents. Among these reins, styrene-based resins having a quaternary ammonium salt, acrylic resins having a quaternary ammonium salt, and styrene-acrylic resins having a quaternary ammonium salt are preferred from the standpoint of the shell layer strength.

The glass transition point (Tg) of the resin constituting the resin particulates is preferably 45° C. or more and 75° C. or less, and more preferably 50° C. or more and 70° C. or less, and particularly preferably 55° C. or more and 65° C. or less. If Tg of the resin constituting the resin particulates is too low, the toner particles may aggregate under a high-temperature and high-humidity environment. On the other hand, if Tg of the resin constituting the resin particulates is too high, the toner may not be sufficiently fixed at low temperatures. The glass transition point of the resin constituting the resin particulates can be measured by the same method as the above-described method for measuring the glass transition point of the binder resin.

The number average molecular weight (Mn) of the resin constituting the resin particulates is preferably 10,000 or more and 100,000 or less, and more preferably 10,000 or more and 40,000 or less. In addition, the molecular weight distribution (Mw/Mn), which is expressed by the ratio of the mass average molecular weight (Mw) to the number average molecular weight (Mn) of the resin constituting the resin particulates, is preferably 1 or more and 5 or less, and more preferably 1 or more and 3 or less. The number average molecular weight (Mn) and the mass average molecular weight (Mw) of the resin constituting the resin particulates can be measured by gel permeation chromatography.

The content of the shell layer is preferably 5 parts by mass or more and 25 parts by mass or less with respect to 100 parts by mass of the toner core.

[External Additive]

The toner manufactured by the manufacturing method according to the present disclosure may contain an external additive attached to the surface of shell layers as needed. Note that the specification and the claims of the present application may use the term "toner mother particle" to refer to a particle before a treatment with an external additive.

Examples of preferred external additives include silica and metal oxides (such as alumina, titanium oxide, magnesium oxide, zinc oxide, strontium titanate, and barium titanate). These external additives may be used singly or two or more types may be used in combination.

The average particle size of the external additive is preferably 0.01 μm or more and 1.0 μm or less. In addition, the amount of the external additive used is preferably 1 part by mass or more and 10 parts by mass or less with respect to 100 parts by mass of the toner mother particles, and more preferably 2 parts by mass or more and 5 parts by mass or less.

[Carrier]

The toner manufactured by the manufacturing method according to the present disclosure may be mixed with a desired carrier and used as a two-component developer. To prepare a two-component developer, it is preferable to use a magnetic carrier.

Examples of preferred carriers include a carrier containing carrier cores covered with resin. Examples of the carrier cores include: particles of iron, oxidized iron, reduced iron, magnetite, copper, silicon steel, ferrite, nickel, or cobalt; particles of alloys of one or more of these materials and a metal, such as manganese, zinc, or aluminum; particles of iron-nickel alloys or iron-cobalt alloys; particles of ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; particles of high-dielectric substances, such as ammonium dihydrogen phosphate, potassium dihydrogen phosphate, and Rochelle salt; and resin carrier cores in which the above magnetic particles are dispersed in a resin.

Examples of the resin covering the carrier core include (meth)acrylic polymers, styrene-based polymers, styrene-(meth)acrylic copolymers, olefin polymers (polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenol resins, xylene resins, diallylphthalate resins, polyacetal resins, and amino resins. These resins may be used singly or two or more types may be used in combination.

The average particle size of the carrier is preferably 20 μm or more and 120 μm or less, and more preferably 25 μm or more and 80 μm or less. The average particle size of the carrier is measured by using an electron microscope.

When the toner manufactured by the manufacturing method according to the present disclosure is used as a two-component developer, the content of the toner is preferably 3% by mass or more and 20% by mass or less with respect to the mass of the two-component developer, and more preferably 5% by mass or more and 15% by mass or less.

<<Method for Manufacturing Electrostatic Latent Image Developing Toner>>

The method for manufacturing an electrostatic latent image developing toner according to the present disclosure involves mixing the aqueous medium dispersion liquid (X) containing negatively chargeable toner cores and the aqueous medium dispersion liquid (Y) containing positively chargeable resin particulates, followed by stirring the mixture liquid to form shell layers each on the surface of the toner cores with the resin particulates.

More specifically, the method for manufacturing an electrostatic latent image developing toner according to the present disclosure involves Processes (I) and (II) below:

Process (I): a mixing process of mixing the aqueous medium dispersion liquid (X) containing negatively chargeable toner cores and the aqueous medium dispersion liquid (Y) containing positively chargeable resin particulates to obtain a mixture liquid containing the toner cores and the resin particulates; and Process (II): a shell layer forming process of stirring the mixture liquid containing the toner cores and the resin particulates to form shell layers each on the surface of the toner cores with the resin particulates.

The method for manufacturing an electrostatic latent image developing toner according to the present disclosure may involve Processes (III) to (V) below in addition to Processes (I) and (II) described above:

Process (III): a washing process of washing toner particles or toner mother particles;

Process (IV): a drying process of drying the washed toner particles or toner mother particles; and Process (V): an external addition process for attaching an external additive to the surface of the toner mother particles.

The following describes Processes (I) to (V).

[(I) Mixing Process]

In (I) Mixing Process, the aqueous medium dispersion liquid (X) and the aqueous medium dispersion liquid (Y) are mixed to yield a mixture liquid containing toner cores and resin particulates. The aqueous medium dispersion liquid (X) contains the negatively chargeable toner cores. The aqueous medium dispersion liquid (Y) contains the positively chargeable resin particulates.

The following describes the method for preparing the aqueous medium dispersion liquid (X) containing the toner cores, and the method for preparing the aqueous medium dispersion liquid (Y) containing the resin particulates.

[Preparation of Aqueous Medium Dispersion Liquid (X)]

The method for preparing the aqueous medium dispersion liquid (X) containing the toner cores is appropriately selectable from among known methods employed to manufacture toner having a core-shell structure. To prepare the aqueous medium dispersion liquid (X), it is preferable to add an anionic surfactant to the aqueous medium dispersion liquid (X). By doing so, the toner cores can be stably dispersed in the aqueous medium dispersion liquid (X).

Examples of the anionic surfactant include sulfate surfactants, sulfonate surfactants, phosphate surfactants, and soaps. Preferred examples of the anionic surfactant include alkyl ether sulfates and polyoxyethylene alkyl ether sulfates. Among the polyoxyethylene alkyl ether sulfates, the one represented by the following chemical formula (1) is particularly preferred.

$$R^1—O—(CH_2CH_2O)_p—SO_3M \quad (1)$$

(In the chemical formula (1), $R^1$ denotes an alkyl group, M denotes a monovalent cation, and p denotes an integer of 1 or more and 50 or less.)

The alkyl group denoted by $R^1$ can be either a straight chain alkyl group or a branched chain alkyl group, but a linear alkyl group is preferred. In addition, the alkyl group denoted by $R^1$ may have an unsaturated bond. The number of carbon atoms contained in the alkyl group denoted by $R^1$ is preferably 10 or more and 20 or less, and more preferably 12 or more and 18 or less. The integer denoted by P is 1 or more and 50 or less. For readily controlling the average particle size of the resin particulates to fall within a preferred range, the integer denoted by P is preferably 1 or more and 30 or less, and more preferably 2 or more and 20 or less. The monovalent cation denoted by M is preferably a sodium ion, a potassium ion, or an ammonium ion, and more preferably a sodium ion or an ammonium ion, and particularly preferably a sodium ion, because such a monovalent cation readily allows control of the average particle size of the resin particulates to fall within a preferred range.

The concentration of the anionic surfactant contained in the aqueous medium dispersion liquid (X) is preferably 0.01% by mass or more and 10% by mass or less.

Since the toner cores are negatively chargeable, the zeta-potential of the toner cores in the aqueous medium dispersion liquid (X) is normally negative. The zeta-potential of the toner cores in the aqueous medium dispersion liquid (X) is preferably −10 mV or less and −50 mV or more, and more preferably −20 mV or less and −40 mV or more. When the zeta-potential of the toner cores contained in the aqueous medium dispersion liquid (X) falls within such a range, the use of the aqueous medium dispersion liquid (X) makes it easier to suppress aggregation of the resin particulates in the process of forming shell layers each with the resin particulates and on the surface of toner cores. If the zeta-potential of the toner cores in the aqueous medium dispersion liquid (X) is too low, the toner cores tend to aggregate with one another in the dispersion liquid. On the other hand, if the zeta-potential of the toner cores in the aqueous medium dispersion liquid (X) is too high, the resin particulates may not easily adhere to the toner cores in (II) Shell Layer Forming Process, which will be described later.

The zeta-potential of the toner cores in the aqueous medium dispersion liquid (X) can be adjusted by adjusting the amount of negatively chargeable functional groups contained in the material(s) constituting the toner cores or the amount of anionic surfactant contained in the aqueous medium dispersion liquid (X).

Preferred examples of the methods for manufacturing the aqueous medium dispersion liquid (X) containing the toner cores include: a method for manufacturing an aqueous medium dispersion liquid containing toner cores by using an aggregation method; and a method for dispersing the toner cores prepared by a melting and kneading method into an aqueous medium. The following now describes the methods for preparing the aqueous medium dispersion liquid (X), one of which uses the toner cores obtained by the aggregation method and the other of which uses the toner cores obtained by the melting and kneading method.

<Aggregation Method>

The aggregation method is preferred as a method for preparing the toner cores contained in the aqueous medium dispersion liquid (X) in that the toner cores to be obtained are likely to be uniform in shape and particle size. The method for manufacturing the aqueous medium dispersion liquid (X) containing the toner cores by using the aggregation method preferably involves Processes (i) and (ii) below:

(i) Aggregation Process of causing the particulates containing the components for forming the toner cores to aggregate in an aqueous medium to form aggregated bodies of particulates; and (ii) Coalescing Process of causing the components contained in the aggregated bodies of particulates to coalesce into toner cores in the aqueous medium.

The following describes (i) Aggregation Process and (ii) Coalescing Process.

((i) Aggregation Process)

The aggregation process involves the use of particulates containing the components for forming the toner cores. The particulates of the components for forming the toner cores may be particulates of a resin composition containing the binder resin described above and one or more optional components (colorant, mold releasing agent, and charge control agent).

The particulates containing the components for forming the toner cores are prepared by forming the binder resin or a composition containing the binder resin into particulates having a desired particle size in an aqueous medium. As a result, an aqueous medium dispersion liquid containing the particulates is prepared. The aqueous medium dispersion liquid containing particulates may additionally contain particulates other than the particulates containing the binder resin. Examples of the particulates other than the particulates containing the binder resin include particulates of a colorant, particulates of a releasing agent, and particulates of both a colorant and a releasing agent. The following sequentially describes a method for preparing the particulates containing the binder resin, a method for preparing the colorant particulates, and a method for preparing the releasing agent particulates. Note that particulates containing components other than those described herein may be prepared by appropriately selecting the methods for preparing such particulates.

Preparation of Particulates Containing Binder Resin

The resin composition contains a binder resin or contains a binder resin with optional components, which may be present in the resulting toner cores. The resin composition is pulverized by a pulverization device, such as Turbo Mill. With the pulverized matter being dispersed in an aqueous medium, such as ion exchanged water, the aqueous medium is heated to a temperature which is equal to or higher by 10° C. than the softening point of the binder resin measured by a flow tester (heated up to 200° C. or so at maximum). The heated binder resin dispersion liquid is then subjected to a strong shear force applied by using a high-speed shear emulsification device, such as CLEARMIX (manufactured by M Technique Co., Ltd.). As a result, an aqueous medium dispersion liquid containing the particulates containing the binder resin is obtained.

The volume average particle size ($D_{50}$) of the particulates containing the binder resin is preferably 1 μm or less, and more preferably 0.05 μm or more and 0.5 μm or less. With the particulates containing the binder resin having the volume average particle size ($D_{50}$) falling within such a range, the toner cores can be readily prepared to have a sharp particle size distribution and a uniform shape. The volume average particle size ($D_{50}$) of the particulates containing the binder resin can be measured by using a device such as a laser diffraction particle size distribution measuring device ("SALD-2200" manufactured by Shimadzu Corporation).

Preferably, a surfactant is contained in the aqueous medium dispersion liquid containing the particulates containing the binder resin. The presence of a surfactant in the aqueous medium dispersion liquid that contains the particulates containing the binder resin can ensure the particulates containing the binder resin to be dispersed stably in the aqueous medium.

The surfactant that can be contained in the aqueous medium dispersion liquid that contains the particulates containing the binder resin is appropriately selectable from the group consisting of anionic surfactants, cationic surfactants, and nonionic surfactants. Examples of the anionic surfactants include the same anionic surfactants as those listed above. Examples of the cationic surfactants include amine salt surfactants and quaternary ammonium salt surfactants. Examples of the nonionic surfactants include polyethylene glycol surfactants, alkylphenol ethylene oxide adduct surfactants, and tri- or higher-hydric alcohol surfactants which are derivatives of tri- or higher-hydric alcohols (such as glycerin, sorbitol, or sorbitan). Among these surfactants, anionic surfactants are preferred. These surfactants may be used singly or two or more types may be used in combination.

The amount of surfactant used is preferably 0.01% by mass or more and 10% by mass or less with respect to the mass of the binder resin.

As described above, to prepare the toner cores, it is preferable to use a resin containing acidic groups, such as carboxyl groups. In the case where the binder resins having acidic groups are used, simply forming the binder resin into particulates in an aqueous medium increases the specific surface of the binder resin. Therefore, the pH of the aqueous medium may decrease to the order of 3 to 4 due to the influence of the acidic groups exposed on the surface of the particulates containing the binder resin. In this case, the binder resin may be hydrolyzed, or the resulting particulates containing the binder resin may not be as small as the desired particle size.

With the aim of preventing such problems, a basic substance may be added to the aqueous medium when the particulates containing the binder resin are prepared. The basic substance is not particularly limited and may be any basic substance that can address the above problems. Examples of such basic substance include alkali metal hydroxides (such as sodium hydroxide, potassium hydroxide, and lithium hydroxide), alkali metal carbonates (such as sodium carbonate and potassium carbonate), alkali metal hydrogencarbonates (such as sodium hydrogencarbonate and potassium hydrogencarbonate), and nitrogen containing basic organic compounds (such as N,N-dimethylethanolamine, N,N-diethylethanolamine, triethanolamine, tripropanolamine, tributhanolamine, triethylamine, n-propylamine, n-butylamine, isopropylamine, monomethanolamine, morpholine, methoxypropylamine, pyridine, and vinylpyridine).

Method for Preparing Releasing Agent Particulates

The following now describes preferred examples of the methods for preparing the releasing agent particulates.

A releasing agent is pulverized, in advance, to an average particle size of about 100 μm or less to obtain powder of the releasing agent. To prepare the releasing agent particulates, the powder of the releasing agent is preferably added to an aqueous medium containing a surfactant to prepare slurry. The amount of surfactant used is preferably 0.01% by mass or more and 10% by mass or less with respect to the mass of the releasing agent.

Next, the resulting slurry is heated to a temperature equal to or higher than the melting point of the releasing agent. The heated slurry is then subjected to a strong shear force applied by a homogenizer ("ULTRA-TURRAX T50" manufactured by IKA Works, Inc.) or a pressure discharge disperser. As a result, the aqueous dispersion liquid containing releasing agent particulates is prepared. Examples of the devices for applying a strong shear force to the dispersion liquid include "NANO3000" manufactured by Beryu Co., "Nanomizer" manufactured by YOSHIDA KIKAI CO., LTD., "Microfluidizer" manufactured by MFI Corporation, "Gaulin Homogenizer" manufactured by Manton Gaulin, and "CLEARMIX W-MOTION" manufactured by M Technique Co., Ltd.

The volume average particle size ($D_{50}$) of the releasing agent particulates contained in the aqueous medium dispersion liquid is preferably 1 μm or less, and more preferably 0.1 μm or more and 0.7 μm or less, and particularly preferably 0.28 μm or more and 0.55 μm or less. With the use of the releasing agent particulates having the volume average particle size ($D_{50}$) falling within such a range, the toner containing the releasing agent uniformly dispersed within the binder resin is readily obtained. The volume average particle size ($D_{50}$) of the releasing agent particulates can be measured by the same method as the measurement of the volume average particle size ($D_{50}$) of the particulates containing the binder resin.

Method for Preparing Colorant Particulates

The following now describes preferred examples of the methods for preparing colorant particulates.

Preferably, the colorant particulates are prepared by dispersing the colorant in an aqueous medium containing a surfactant by a known disperser, possibly together with other components such as a dispersant for the colorant as needed. The surfactants that can be used as the dispersant are the above-described types of surfactants used to prepare the particulates containing the binder resin. The amount of the surfactant used is preferably 0.01% by mass or more and 10% by mass or less.

Examples of the disperser used in the dispersing include ultrasonic dispersers, pressure dispersers (such as mechanical homogenizers, Manton-Gaulin homogenizers, pressure homogenizers, and high-pressure homogenizers manufactured by YOSHIDA KIKAI CO., LTD.), and medium dispersers (such as sand grinders, horizontal and vertical bead mills, "Ultra Apex Mill" manufactured by Kotobuki Industrial Co., Ltd., "Dyno Mill" manufactured by WAB AG, and "MSC Mill" manufactured by Nippon Coke & Engineering Co., Ltd.).

The volume average particle size ($D_{50}$) of the colorant particulates is preferably 0.05 μm or more and 0.2 μm or less. The volume average particle size ($D_{50}$) of the colorant particulates can be measured by the same method as the measurement of the volume average particle size ($D_{50}$) of the particulates containing the binder resin.

The aqueous medium dispersion liquid containing the particulates containing the binder resin prepared by any of the above methods may be appropriately combined with the aqueous medium dispersion liquid containing the releasing agent particulates and/or with the aqueous medium dispersion liquid containing the colorant particulates as needed in order for the resulting toner cores to contain the predetermined component(s). Thereafter, these particulates are caused to aggregate to obtain an aqueous medium dispersion liquid containing the aggregated bodies of particulates containing the binder resin. Preferred methods for aggregating these particulates include a method in which: the pH of the aqueous medium dispersion liquid containing the particulates containing the binder resin is adjusted; an aggregating agent is added to the aqueous medium dispersion liquid; and then the aqueous medium dispersion liquid is adjusted to a predetermined temperature to cause aggregation of the particulates.

Examples of preferred aggregating agents include inorganic metal salts, inorganic ammonium salts, and divalent or higher-valent metal complexes. Examples of the inorganic metal salts include metal salts (such as sodium sulfate, sodium chloride, calcium chloride, calcium nitrate, barium chloride, magnesium chloride, zinc chloride, aluminum chloride, and aluminum sulfate), and inorganic metal salt polymers (such as polyaluminum chloride and polyaluminum hydroxide). Examples of the inorganic ammonium salts include ammonium sulfate, ammonium chloride, and ammonium nitrate. In addition, nitrogen-containing compounds, such as quaternary ammonium salt cationic surfactants and polyethylenimine, may also be used as the aggregating agent.

As the aggregating agent, a divalent metal salt and a monovalent metal salt are preferably used. The aggregating agent may be used singly or two or more types may be used in combination. When two or more types of the aggregating agents are used in combination, a combined use of a divalent metal salt and a monovalent metal salt is preferred for the following reason. That is, the aggregation rate of particulates caused by a divalent metal salt differs from the aggregation rate of particulates caused by a monovalent metal salt. Therefore, a combined use of a divalent metal salt and a monovalent metal salt ensures the resulting aggregated bodies of particulates to have a sharp particle size distribution while preventing the particle size of the aggregated bodies of particulates from being larger.

Preferably, the aggregating agent is added after the pH adjustment of the dispersion liquid containing the particulates. The pH of the aqueous medium dispersion liquid at the time of adding the aggregating agent is preferably 8 or higher. In addition, the aggregating agent may be added all at once or in portions.

The amount of the aggregating agent to be added is preferably 1 part by mass or more and 50 parts by mass or less with respect to 100 parts by mass of the sold content of the aqueous medium dispersion liquid. It is preferable to appropriately adjust the amount of the aggregating agent to be added, depending on the type and amount of the anionic or nonionic dispersant contained in the dispersion liquid containing the particulates.

The temperature of the aqueous medium dispersion liquid at the time of causing the aggregation of particulates is preferably equal to or higher than the glass transition point (Tg) of the binder resin and lower than a temperature that is equal to Tg+10° C. By heating the aqueous medium dispersion liquid containing the particulates containing the binder resin to such temperatures, the aggregation of the particulates contained in the aqueous medium dispersion liquid can sufficiently progress.

An aggregation terminating agent may be added after the aggregation of the particulates progress to yield aggregated bodies of particulates of a desired particle size. Examples of the aggregation terminating agent include sodium chloride, potassium chloride, and magnesium chloride. In this manner, the aqueous medium dispersion liquid containing aggregated bodies of particulates can be obtained.

((ii) Coalescing Process)

(ii) Coalescing Process involves heating the aqueous medium dispersion liquid containing the aggregated bodies of particulates obtained in the above-described manner, thereby causing the components contained in the aggregated bodies of particulates to coalesce. As a result, the aqueous medium dispersion liquid (X) containing the toner cores having a desired particle size is obtained. Preferably, the aqueous medium dispersion liquid containing the aggregated bodies of particulates is heated to a temperature that is equal to or higher than the glass transition point (Tg) of the binder resin+10° C. and that is equal to or lower than the melting point of the binder resin. Heating the aqueous medium dispersion liquid containing the aggregated bodies of particulates to such temperatures causes the components contained in the aggregated bodies of particulates to coalesce sufficiently.

<Melting and Kneading Method>

The melting and kneading method involves: mixing the binder resin and optional components (colorant, releasing agent, charge control agent, or magnetic powder); melting and kneading the mixture; pulverizing the melted and kneaded matter; and classifying the pulverized matter to obtain toner cores having a desired particle size.

The toner core obtained through the melting and kneading method is dispersed in an aqueous medium in the presence of the above-described surfactant as needed. This prepares the aqueous medium dispersion liquid (X).

[Preparation of Aqueous Medium Dispersion Liquid (Y)]

Examples of the methods for preparing the aqueous medium dispersion liquid (Y) include: a method in which a resin is formed into resin particulates in an aqueous medium by using the same method as the one used for preparing the particulates containing the binder resin described above; and a method in which monomers having a predetermined composition is polymerized in an aqueous medium using a known method to form resin particulates.

In addition, the aqueous medium dispersion liquid (Y) preferably contains resin particulates stirred together with an anionic surfactant. This is particularly advantageous for preventing aggregation of the resin particulates with one another in the process of forming shell layers each on the surface of the toner cores with the resin particulates.

In the case where the aqueous medium dispersion liquid (Y) contains an anionic surfactant, the concentration of the anionic surfactant in the aqueous medium dispersion liquid (Y) is preferably 0.01% by mass or more and 10% by mass or less, and more preferably 2% by mass or more and 10% by mass or less.

The zeta-potential of the positively chargeable resin particulates in an aqueous medium is normally positive. However, when the aqueous medium dispersion liquid (Y) contains the resin particulates stirred together with an anionic surfactant as described above, the resin particulates contained in the aqueous medium dispersion liquid (Y) will have a negative zeta-potential by the action of the anionic surfactant to the resin particulates. When the aqueous medium dispersion liquid (Y) contains the resin particulates stirred together with an anionic surfactant as described above, the zeta-potential of the resin particulates in the aqueous medium dispersion liquid (Y) is preferably −20 mV or less and −70 mV or more, and more preferably −30 mV or less and −60 mV or more. If the zeta-potential of the resin particulates in the aqueous medium dispersion liquid (Y) is too high, the resin particulates may not sufficiently adhere to the toner cores.

The volume average particle size ($D_{50}$) of the resin particulates contained in the aqueous medium dispersion liquid (Y) is preferably 0.03 μm or more and 0.50 μm or less, and more preferably 0.05 μm or more and 0.30 μm or less. When the resin particulates for covering the toner cores have a volume average particle size ($D_{50}$) falling within such a range, the resin particulates are likely to cover the surface of toner cores uniformly. The volume average particle size ($D_{50}$) of the resin particulates for covering the surface of the toner cores can be measured by using a measurement devices such as an electrophoretic light scattering photometer ("LA-950V2" manufactured by HORIBA, Ltd.).

[(II) Shell Layer Forming Process]

The following describes (II) Shell Layer Forming Process. First, a mixture liquid containing the toner cores and the resin particulates is prepared in the manner described above. Then, the mixture liquid is stirred to form shell layers each on the surface of the toner cores with the resin particulates. As a result, the toner particles (toner mother particles) are obtained. The shell layers are formed with the resin particulates stirred together with an anionic surfactant. When the resin particulates are stirred together with an anionic surfactant, the anionic surfactant affects the surface of the positively chargeable resin particulates, which are the material of the shell layers. As a consequence, the positive potential at the surface of the resin particulates is reduced or changed into a negative potential. Therefore, by using the resin particulates stirred together with an anionic surfactant to form the shell layers each on the surface of the toner cores, aggregation of the resin particulates can be suppressed.

Examples of the methods for stirring the resin particulates with an anionic surfactant include the following methods (A), (B), and (C).

In the method (A), the resin particulates are stirred together with an anionic surfactant when the aqueous medium dispersion liquid (Y) described above is prepared. In the method (B), an anionic surfactant is added to at least either the aqueous medium (X) or the aqueous medium dispersion liquid (Y) when the aqueous medium dispersion liquid (X) and the aqueous medium dispersion liquid (Y) are mixed.

In the method (C), the aqueous medium dispersion liquid (X), the aqueous medium dispersion liquid (Y), and an anionic surfactant are mixed to prepare a mixture liquid.

In the methods (B) and (C), the mixture liquid resulting from mixing the aqueous medium dispersion liquid (X) and the aqueous medium dispersion liquid (Y) is stirred for forming the shell layers. Through the stirring of the mixture liquid, the resin particulates contained in the mixture liquid are stirred together with the anionic surfactant before or simultaneously with the formation of the shell layers. As a result, the anionic surfactant affects the surface of the resin particulates to change the zeta-potential at the surface of the resin particulates from the positive polarity to a weaker positive polarity or to the negative polarity.

Among the methods (A), (B), and (C), the method (A) is preferred. The method (A) can cause the anionic surfactant to effectively affect the surface of the resin particulates by adding the anionic surfactant to the aqueous medium dispersion liquid (Y) containing the positively chargeable resin particulates, which is the material of the shell layers and then stirring the mixture, both before preparation of the mixture liquid. Therefore, the zeta-potential of the resin particulates contained in the aqueous medium dispersion liquid (Y) can be effectively changed from the positive polarity to the negative polarity.

Examples of the method for stirring the resin particulates with an anionic surfactant after adding the anionic surfactant to the aqueous medium dispersion liquid (Y) containing the positively chargeable resin particulates include: a method using a stirrer provided with a stirring blade (such as a paddle-type impeller, a propeller-type impeller, or a turbine-type impeller) rotated by a motor; and a method using an ultrasonic disperser for ultrasonic irradiation. Among these stirring methods, the method using a stirrer for stirring the aqueous medium dispersion liquid (Y) is preferred. Among the stirrers, a stirrer capable of causing strong stirring or high-pressure emulsification of the aqueous medium dispersion liquid (Y) is preferred. By using such a stirrer for stirring the resin particulates in the aqueous medium dispersion liquid (Y) with the anionic surfactant, the anionic surfactant can effectively affect the resin particulates. Therefore, when the aqueous medium dispersion liquid (Y) having been stirred by such a stirrer is used to prepare a mixture liquid, aggregation of the resin particulates in the shell layer forming process is suppressed particularly effectively.

Examples of the devices capable of causing strong stirring or high-pressure emulsification of the aqueous medium dispersion liquid (Y) include a mixer (such as a homodisper, a homomixer, "Filmix" manufactured by PRIMIX Corporation, "CLEARMIX" manufactured by M Technique Co., Ltd., and "CLEARMIX W-MOTION" manufactured by M Technique Co., Ltd., "Gaulin Homogenizer" manufactured by Manton Gaulin, "NANO3000" manufactured by Beryu Co., Ltd., "Nanomizer" manufactured by YOSHIDA KIKAI CO., LTD., and "Microfluidizer" manufactured by MFI Corporation.

After the treatment of the aqueous medium dispersion liquid (Y) by the device capable of causing strong stirring or high-pressure emulsification, the zeta-potential of the resin particulates in the aqueous medium dispersion liquid (Y) is preferably −70 mV or more and −20 mV or less. Through the strong stirring or high-pressure emulsification of the aqueous medium dispersion liquid (Y) performed to ensure that the zeta-potential of the resin particulates in the aqueous medium dispersion liquid (Y) is −70 mV or more and −20 mV or less, it is particularly more likely to suppress aggregation of the rein particulates when forming the shell layers.

Once the mixture liquid is prepared, the resin particulates, which are the material of the shell layers, are in the state tending to aggregate with one another. For this reason, it is preferable to start stirring the mixture liquid immediately after the mixture liquid is prepared.

After the shell layers are formed each on the surface of the toner cores with the resin particulates, the aqueous medium dispersion liquid may be heated. The temperature for heating the aqueous medium dispersion liquid is preferably equal to or higher than the glass transition point (Tg) of the resin constituting the resin particulates and equal to or lower than 90° C. By heating the aqueous medium dispersion liquid to a temperature falling within such a range, the resin particulates for covering the toner cores are sufficiently formed into films and then sufficiently into shell layers covering the surfaces of the toner cores.

Examples of the stirrer used for stirring the mixture liquid include "T.K. Filmix" manufactured by PRIMIX Corporation, "ROBOMIX" manufactured by PRIMIX Corporation, and "CAVITRON" manufactured by Eurotec, Ltd.

The particles having a core-shell structure formed through (I) Mixing Process and (II) Shell Layer Forming Process described above are collected as the toner particles or toner mother particles from the mixture liquid.

[(III) Washing Process]

In (III) Washing Process, the toner mother particles formed in the above-described manner are washed with water. One example of the washing method involves collecting the toner particles or toner mother particles as wet cake from the mixture liquid containing the toner particles or toner mother particle by solid-liquid separation, and the thus collected wet cake is washed with water. Another method involves causing the toner particles or toner mother particles in the mixture liquid to precipitate, replacing the supernatant with water, and the toner particles or toner mother particles are dispersed again in water after the replacement.

[(VI) Drying Process]

Preferably, the toner particles or toner mother particles obtained through (II) Shell Layer Forming Process or (III) Washing Process are dried in (IV) Drying Process. Examples of a preferred drying method include methods performed by using a dryer (such as a spray dryer, a fluidized bed dryer, a vacuum freeze dryer, and a reduced pressure dryer). Among these methods, the one performed by using a spray dryer is more preferred as the method readily allows suppression of aggregation of the toner particles or toner mother particles during drying.

[(V) External Addition Process]

The electrostatic latent image developing toner may have an external additive attached to the surface of toner mother particles as needed. When the particles formed to have a core-shell structure through Processes (I) and (II) are collected as the toner mother particles, an external additive may be attached to the surface of the toner mother particles through (V) External Addition Process. Examples of a preferred method for attaching the external additive to the surface of the toner mother particles through Process (V) include one involving mixing the toner mother particles with the external additive by using a mixer (such as a Henschel mixer or a Nauta mixer) under the conditions adjusted to ensure that the external additive is not embedded in the surface of the toner mother particles.

As has been described above, the method for manufacturing an electrostatic latent image developing toner according to the present disclosure can ensure to suppress aggregation of the resin particulates, which are for forming the shell layers, at the time of forming the shell layers each on the surface of the toner cores with the resin particulates.

EXAMPLES

The following describes the present disclosure further specifically by using examples. It should be noted that the present disclosure is in no way limited to the scope of the examples.

Preparation Example 1

Preparation of Dispersion Liquid of Particulates Containing Binder Resin

Dispersion Liquid I of Particulates Containing Binder Resin

By following the method below, Dispersion Liquid I of particulates containing the binder resin was prepared.

As the binder resin, the polyester resin described below was used.

Monomer composition: polyoxypropylene(2,2)-2,2-bis(4-hydroxyphenyl)propane/polyoxyethylene(2,0)-2,2-bis(4-hydroxyphenyl)propane/fumaric acid/trimellitic acid=25/25/46/4 (mole fraction)

Number average molecular weight (Mn): 2,500
Mass average molecular weight (Mw): 6,500
Molecular weight distribution (Mw/Mn): 2.6
Softening point (Tm): 91° C.
Glass transition point (Tg): 51° C.
Acid value: 15.5 mgKOH/g The polyester resin was pulverized into particles having an average particle size of about 10 μm by using "Turbo Mill T250" manufactured by FREUND-TURBO CORPORATION. Then, 100 g of the pulverized polyester resin was mixed with 2 g of Dispersant A (anionic surfactant, "Emal E-27C" manufactured by Kao Corporation, sodium polyoxyethylene laurylether sulfate) and 50 g of 0.1N-aqueous sodium hydroxide solution (basic substance). To the thus obtained mixed solution, ion exchanged water was added as an aqueous medium to prepare a total of 500 g of slurry.

The resulting slurry was poured into a pressure-proof, round-bottom stainless steel container. Then, by using a high-speed shear emulsification device "CLEARMIX" ("CLM-2.2S") manufactured by M Technique Co., Ltd., the slurry was subjected to shear dispersion for 30 minutes at a rotor rotational speed of 20,000 rpm while the slurry was heated and pressurized at 145° C. and 0.5 MPa(G). After the shear dispersion, while being cooled at a rate of 5° C./minute, the slurry was stirred at a rotor rotational speed of 15,000 rpm until the temperature inside the stainless steel container reached 50° C. Thereafter, the slurry was cooled to normal temperature at a rate of 5° C./minute. After the slurry was cooled to normal temperature, ion exchanged water was added to the slurry such that the solid concentration to the dispersion liquid was 5% by mass. As a result, a liquid in which polyester resin particulates having an average particle size of about 140 nm were dispersed was obtained as Dispersion Liquid I of the particulates containing the binder resin. The average particle size of the particulates in the dispersion liquid was measured by using a particle size distribution measuring device ("Microtrac UPA 150" manufactured by Nikkiso Co., Ltd.).

Dispersion Liquid II of Particulates Containing Binder Resin

By following the method below, Dispersion Liquid II of particulates containing the binder resin was prepared.

Into a 1-liter four-neck flask equipped with a stirrer, a condenser, a thermometer, and a nitrogen inlet tube, 550 ml of ion exchanged water and 0.35 g of Dispersant A was placed and heated to 80° C. while being stirred under a nitrogen gas stream. Then, 81 g of potassium persulfate aqueous solution (concentration: 2.5% by mass) was added as a polymerization initiator. Then, by using a dropping funnel, a monomer mixture liquid containing 89 g of styrene, 58 g of n-butyl acrylate, 14 g of methacrylic acid, and 3.3 g of n-octyl mercaptan as a chain transfer agent, was dripped over 1.5 hours. After the dripping, the reaction liquid was stirred for two hours at the same temperature to complete the polymerization reaction. After completion of the polymerization reaction, the content was cooled to room temperature, followed by addition of ion exchanged water to the reaction liquid until the solid concentration was 10% by mass. As a result, Dispersion Liquid II of the particulates containing the binder resin was obtained. In Dispersion Liquid II of the particulates containing the binder resin, acrylic resin particulates having an average particle size of about 90 nm and the following physical properties were dispersed. The average particle size of the acrylic resin particulates were measured by using the same method as that used for measuring the average particle size of the polyester resin particulates.

Number average molecular weight (Mn): 5,400
Mass average molecular weight (Mw): 18,000
Molecular weight distribution (Mw/Mn): 3.3
Softening point (Tm): 91° C.
Glass transition point (Tg): 46° C.

Preparation Example 2

(Preparation of Dispersion Liquid of Releasing Agent Particulates)

By following the method below, the dispersion liquid of releasing agent particulates was prepared.

A mixture liquid containing 200 g of a releasing agent ("WEP-5", which is pentaerythritol behenate wax having a melting point of 84° C., manufactured by NOF Corporation), 2 g of Dispersant A, and 800 g of ion exchanged water was prepared. The mixture liquid was then heated to 100° C. to melt the releasing agent, and subjected to emulsification for 60 minutes by using "CLEARMIX W-MOTION" manufactured by M TECHNIQUE Co., Ltd. In this way, the dispersion liquid containing the releasing agent particulates having an average particle size of 280 nm and a melting point of 83° C. was yielded at the solid concentration of 20% by mass.

Preparation Example 3

(Preparation of Dispersion Liquid of Colorant Particulates)

By following the method below, a dispersion liquid of the colorant particulates was prepared.

A mixture liquid containing 90 g of cyan colorant (C.I. pigment blue 15:3, which is copper phthalocyanine), 10 g of Dispersant B (anionic surfactant: "EMAL 0" manufactured by Kao Corporation, sodium laurylsulfate), and 400 g of ion exchanged water was prepared. The mixture liquid was then emulsified and dispersed over one hour by using "Ultimizer", a high-pressure impact type dispersing machine ("HJP30006" manufactured by Sugino Machine Limited). This yielded the dispersion liquid of the colorant particulates having a solid concentration of 18% by mass.

The particle size distribution of the colorant particulates contained in the resulting dispersion liquid of the colorant particulates was measured by using a particle size distribution measuring device ("Microtrac UPA 150" manufactured by Nikkiso Co., Ltd.). The volume average particle size (MV) of the colorant particulates contained in the resulting dispersion liquid of the colorant particulates was 160 nm and the Cv value of the particle size distribution was 25%. In addition, from a TEM image of the colorant particulates, the average circularity of the colorant particulates was found to be 0.80.

Preparation Example 4

(Preparation of Dispersion Liquid of Resin Particulates)

A 2-liter four-neck flask equipped with a stirrer, a condenser, a thermometer, and a nitrogen inlet tube was used as a reaction container. Into the reaction container, 180 g of isobutanol was added, followed by addition of 16 g of diethylaminoethyl methacrylate and 16 g of methyl p-toluenesulfonate. The content of the flask was stirred over one hour under a nitrogen atmosphere, at 80° C., and at a stirring rate of 230 rpm (until completion of the polymerization reaction) to cause a quaternization reaction. Next, under a nitrogen gas stream, 214 g of styrene, 72 g of butyl acrylate, and 12 g of t-butyl peroxy-2-ethylhexanoate (manufactured by Arkema Yoshitomi, Ltd.) as a peroxide initiator were added to the reaction container. Then, the content of the reaction container was heated to 95° C. (polymerization temperature), followed by stirring the content of the reaction container for three hours at the same temperature. Further, 6 g of t-butyl peroxy-2-ethylhexanoate was added to the reaction container. Then, the content of the reaction container was stirred for 3 hours at 95° C. to complete the polymerization reaction. The content of the reaction container was filtered and washed repeatedly to obtain a styrene-acrylic resin.

The resulting styrene-acrylic resin was pulverized using "Turbo Mill T250" manufactured by FREUND-TURBO CORPORATION to obtain pulverized styrene-acrylic resin having an average particle size of 30 μm or more and 50 μm or less. Then, a mixture liquid containing 200 g of the pulverized styrene-acrylic resin, 20 g of Dispersant B (sodium laurylsulfate) and 780 g of ion exchanged water was prepared, and the mixture liquid was subjected to emulsification performed one time by using a high-pressure homogenizer equipped with a heating system ("NV-200" manufactured by YOSHIDA KIKAI CO., LTD.) at 170° C. and at a discharge pressure of 150 MPa. In this way, the dispersion liquid containing the resin particulates having the pH of 5.8 and the volume average particle size of 250 nm was yielded at the solid concentration of 20% by mass. In the resulting dispersion liquid of the resin particulates, the zeta-potential of the resin particulates was +60 mV. The zeta-potential of the dispersion liquid was measured by using an ultrasonic measuring device for the zeta potential and the particle size distribution ("DT-1200" manufactured by Dispersion Technology Inc.).

Preparation Example 5

(Preparation of Dispersion Liquid of Toner Cores)

Dispersion Liquid A of Toner Cores

With the use of the following dispersion liquids of particulates, a dispersion liquid of toner cores was prepared.

Dispersion Liquid I of the particulates containing the binder resin (solid concentration of 5% by mass): 425 g Dispersion liquid of the releasing agent particulates (solid concentration of 20% by mass): 12.5 g Dispersion liquid of the colorant particulates (solid concentration of 18% by mass): 7 g Into a 1-liter four-neck flask, a thermometer, a cooling tube, and a stirrer were set. The three types of dispersion liquids of the particulates listed above were put into the flask together with 0.2 g of Dispersant B and 43.5 g of ion exchanged water, followed by stirring at a stirring rate of 200 rpm. Further, triethanolamine was added to the flask to adjust the pH of the content of the flask to 9. Then, an aqueous solution prepared by dissolving 4.0 g of magnesium chloride hexahydrate in 4.0 g of ion exchanged water was added to the flask. The dispersion liquid in the flask was left to stand for five minutes, and then the content of the flask was first heated to 50° C. at a heating rate of 5° C./minute, and then to 73° C. at a heating rate of 0.5° C./minute. Thereafter, the temperature of the dispersion liquid was maintained at 73° C. When the volume average particle size of the aggregated particulates in the dispersion liquid reached 6.5 μm, the dispersion liquid was stirred at a stirring rate of 350 rpm for ten minutes. After the stirring, the content of the flask was cooled to room temperature at a cooling rate of 5° C./minute. This yielded Dispersion Liquid A of the toner cores having a volume average particle size (MV) of 6.6 μm, a number average particle size (MN) of 5.7 μm, and an average circularity of 0.93. The resulting Dispersion Liquid A of the toner cores exhibited the pH of 8.3, the electric conductivity of 18.9 mS/cm, and the zeta-potential of the toner cores in the dispersion liquid was −40 mV. The electrical conductivity of the dispersion liquid was measured by using an electrical conductivity meter ("ES-51" manufactured by HORIBA, Ltd.)

Dispersion Liquid B of Toner Cores

With the use of the following dispersion liquids of the particulates, a dispersion liquid of toner cores was prepared.

Dispersion liquid II of the particulates containing the binder resin (solid concentration of 5% by mass): 213 g Dispersion liquid of the releasing agent particulates (solid concentration of 20% by mass): 12.5 g Dispersion liquid of the colorant particulates (solid concentration of 18% by mass): 7 g Into a 1-liter four-neck flask, a thermometer, a cooling tube, and a stirrer were set. The three types of the dispersion liquids of the particulates listed above were put into the flask together with 0.15 g of Dispersant B and 270 g of ion exchanged water, followed by stirring at a stirring rate of 200 rpm. Further, triethanolamine was added to the flask to adjust the pH of the content of the flask to 10. Then, an aqueous solution prepared by dissolving 4.0 g of magnesium chloride hexahydrate in 4.0 g ion exchanged water was added to the flask. The dispersion liquid in the flask was left to stand for five minutes, and then the content of the flask was first heated to 50° C. at a heating rate of 5° C./minute, and then to 73° C. at a heating rate of 0.5° C./minute. Thereafter, the temperature of the dispersion liquid was maintained at 73° C. When the volume average particle size of the aggregated particulates in the dispersion liquid reached 6.5 μm, the dispersion liquid was stirred at a stirring rate of 350 rpm for ten minutes. After the stirring, the content of the flask was cooled to room temperature at a cooling rate of 5° C./minute. This yielded Dispersion liquid B of the toner cores having a volume average particle size (MV) of 6.6 μm and a number average particle size (MN) of 5.6 μm. The resulting Dispersion Liquid B of the toner cores exhibited the pH of 7.2, the electric conductivity of 18.5 mS/cm, and the zeta-potential of the toner cores in the dispersion liquid was −30 my.

Examples 1-4, 6, 7 and Comparative Example 2

Together with the respective dispersants of the types and amounts listed in Tables 1-3, and ion exchanged water of the respective amounts listed in Tables 1-3, 20 g of the dispersion liquid of the resin particulates obtained in Preparation Example 4 was subjected to the respective mixing treatments listed in Tables 1-3 for ten minutes.

Dispersants B-D listed in Tables 1-3 are as follows.

Dispersant B: anionic surfactant ("Emal 0" manufactured by Kao Corporation, sodium laurylsulfate)

Dispersant C: anionic surfactant (manufactured by Nacalai Tesque, Inc. sodium dodecylbenzenesulfonate)

Dispersant D: nonionic surfactants ("EMULGEN 120" manufactured by Kao Corporation, polyoxyethylene lauryl ether)

The mixing treatments A-C listed in Tables 1-3 are as follows.

Mixing Treatment A: Desktop ultrasonic cleaner ("US-18KS" manufactured by SND Co., Ltd.), Conditions (5-minute ultrasonic irradiation).

Mixing Treatment B: Homodisper ("ROBOMIX" manufactured by PRIMIX Corporation), Conditions (3-minute stirring at stirring rate of 10000 rpm)

Mixing Treatment C: Nanomizer ("C-ES" manufactured by YOSHIDA KIKAI CO., LTD.), Conditions (treated twice at a pressure of 20 MPa)

Four-neck flasks other than the one used in Preparation Example 5 were prepared, and a temperature sensor, a cooling tube, and a stirrer were set to each four-neck flask. Then, 200 g of the dispersion liquid containing the toner cores of the types prepared in Preparation Example 5 and listed in Tables 1-3 were put into the respective flasks. Next, while the dispersion liquid of the toner cores in each flask was maintained at 50° C. and stirred at a stirring rate of 350 rpm, the dispersion liquid of the resin particulates having been subjected to the mixing treatment was added to the flask. Thereafter, the content of each flask was heated to 75° C. at a heating rate of 1° C./minute while being stirred at a stirring rate of 350 rpm. Then, the content of each flask was maintained at 75° C. and stirred for 2 hours at a stirring rate 350 rpm, followed by cooling to room temperature at a cooling rate of 5° C./minute. This yielded the respective dispersion liquids of the toner particles.

The volume average particle size (MV) and the number average particle size (MN) of the toner particles contained in the each resulting dispersion liquid were measured by using "Coulter Counter Multisizer 3" manufactured by Beckman Coulter, Inc. The volume average particle size (MV) and the number average particle size (MN) of the toner particles are shown in Tables 1-3.

Example 5

A four-neck flask other than the one used in Preparation Example 5 was prepared, and a temperature sensor, a cooling tube, and a stirrer were set to the four-neck flask. Then, 200 g of the dispersion liquid of the toner cores prepared in Preparation Example 5 was put into the flask. Next, while the dispersion liquid of the toner cores in the flask was maintained at 50° C. and stirred at a stirring rate of 350 rpm, an aqueous dispersant solution prepared by dissolving 2 g of Dispersant B in 18 g of ion exchanged water was added to the flask, followed by stirring for 15 minutes at stirring rate of 350 rpm. Thereafter, 20 g of the dispersion liquid of the resin particulates prepared by Preparation Example 4 was added to the flask. Then, the content of the flask was heated to 75° C. at a heating rate of 1° C./minute while being stirred at a stirring rate of 350 rpm. Thereafter, the content of the flask was maintained at 75° C. and stirred for 2 hours at a stirring rate of 350 rpm, followed by cooling to room temperature at a cooling rate of 5° C./minute. This yielded the dispersion liquid of the toner particles. The volume average particle size (MV) and the number average particle size (MN) of the toner particles contained in the resulting dispersion liquid are shown in Table 1.

Comparative Example 1

A four-neck flask other than the one used in Preparation Example 5 was prepared, and a temperature sensor, a cooling tube, and a stirrer were set to the four-neck flask. Then, 200 g of the dispersion liquid of the toner cores prepared in Preparation Example 5 was put into the flask. Thereafter, while the dispersion liquid of the toner cores in the flask was maintained at 50° C. and stirred at a stirring rate of 350 rpm, 20 g of the dispersion liquid of the resin particulates prepared by Preparation Example 4 was added to the flask. Then, the content of the flask was heated to 75° C. at a heating rate of 1° C./minute while being stirred at a stirring rate of 350 rpm. Thereafter, the content of the flask was maintained at 75° C. and stirred for 2 hours at a stirring rate 350 rpm, followed by cooling to room temperature at a cooling rate of 5° C./minute. This yielded the dispersion liquid of the toner particles. The volume average particle size (MV) and the number average particle size (MN) of the toner particles contained in the resulting dispersion liquid are shown in Table 2.

<Toner Quality Evaluations>

The toner quality was evaluated for the respective dispersion liquids of the toner particles obtained in Examples 1-7 and Comparative Examples 1 and 2. Specifically, for each dispersion liquid of the toner particles, the number of resin particulates and aggregated bodies of the resin particulates contained in the dispersion liquid was measured by using "FPIA-3000" manufactured by Sysmex Corporation. The particles having a particle size of 2.876 μm or less contained in the dispersion liquid of the toner particles were regarded as resin particulates or aggregated bodies of resin particulates, and the number of such resin particulates and aggregated bodies of resin particulates were measured. The number of resin particulates and aggregated bodies of resin particulates and the number of all the particles contained in the dispersion liquid targeted for the measurement were substituted into the following expression to calculate the ratio of the number of resin particulates and aggregated bodies of resin particulates to the number of all the particles contained in the dispersion liquid of the toner particles (to calculate a non-shell resin particulate ratio).

(Non-shell resin particulate ratio)(%)=(Number of resin particulates and aggregated bodies of resin particulates)/(Number of all particles)×100

Based on the thus calculated non-shell resin particulate ratios, the toner quality is evaluated by the following criteria. The evaluation results are shown in Tables 1-3.

Very Good: Non-shell resin particulate ratio was less than 5%

Good: Non-shell resin particulate ratio was 5% or more and less than 10%

Poor: Non-shell resin particulate ratio was 10% or more

TABLE 1

| Examples | | 1 | 2 | 3 | 4 | 5 |
|---|---|---|---|---|---|---|
| Dispersion Liquid of Toner Cores | Type | A | A | A | A | A |
| | Dispersant Type/Amount [g] | — | — | — | — | B/2 |
| | Ion Exchange Water Amount [g] | — | — | — | — | 18 |
| | Zeta potential [mV] | −40 | −40 | −40 | −40 | −42 |
| Dispersion Liquid of Resin Particulates | Dispersant Type/Amount [g] | B/1.6 | B/2.4 | B/1.6 | B/1.6 | — |
| | Ion Exchange Water Amount [g] | 58.4 | 57.6 | 58.4 | 58.4 | — |
| | Mixing Treatment | A | A | B | C | — |
| | Zeta potential [mV] | −50 | −65 | −65 | −65 | 60 |
| Volume Average Particle Size (MV) [μm] | | 6.73 | 6.78 | 6.77 | 6.54 | 6.78 |
| Number Average Particle Size (Mn) [μm] | | 5.61 | 5.93 | 5.90 | 5.81 | 5.66 |
| MV/MN | | 1.20 | 1.14 | 1.15 | 1.13 | 1.20 |
| Toner Quality Evaluation | | Good | Good | Very Good | Very Good | Good |

TABLE 2

| | | Examples | |
|---|---|---|---|
| | | 6 | 7 |
| Dispersion Liquid of Toner Cores | Type | A | B |
| | Zeta potential [mV] | −40 | −30 |
| Dispersion Liquid of Resin Particulates | Dispersant Type/Amount [g] | C/2.4 | B/1.6 |
| | Ion Exchange Water Amount [g] | 57.6 | 58.4 |
| | Mixing Treatment | A | A |
| | Zeta potential [mV] | −55 | −50 |
| Volume Average Particle Size (MV) [μm] | | 6.75 | 6.77 |
| Number Average Particle Size (Mn) [μm] | | 5.70 | 5.88 |
| MV/MN | | 1.18 | 1.15 |
| Toner Quality Evaluation | | Good | Good |

TABLE 3

| | | Comparative Examples | |
|---|---|---|---|
| | | 1 | 2 |
| Dispersion Liquid of Toner Cores | Type | A | A |
| | Zeta potential [mV] | −40 | −40 |
| Dispersion Liquid of Resin Particulates | Dispersant Type/Amount [g] | — | D/2.4 |
| | Ion Exchange Water Amount [g] | — | 57.6 |
| | Mixing Treatment | — | A |
| | Zeta potential [mV] | 60 | 55 |
| Volume Average Particle Size (MV) [μm] | | 6.58 | 6.60 |
| Number Average Particle Size (Mn) [μm] | | 5.61 | 5.70 |
| MV/MN | | 1.17 | 1.16 |
| Toner Quality Evaluation | | Poor | Poor |

Examples 1-7 show the following with respect to the electrostatic latent image developing toners obtained through: a mixing process of mixing the aqueous medium dispersion liquid (X) containing negatively chargeable toner cores with the aqueous medium dispersion liquid (Y) containing positively chargeable resin particulates, followed by stirring process of stirring the mixture liquid; and a shell layer forming process of forming shell layers each by covering a toner core with the resin particulates subjected to a stirring treatment together with an anionic surfactant. Obtaining the electrostatic latent image developing toners in this way can suppress aggregation of the resin particulates in forming the shell layers and ensure that the toners obtained are of high quality.

Examples 3 and 4 show that the effect of suppressing aggregation of the resin particulates in forming the shell layers is greater by subjecting the aqueous medium dispersion liquid (Y) containing the resin particulates to the mixing treatment performed by using a mixer, such as a homodisper, a homomixer, Filmix, CLEARMIX, CLEARMIX W-MOTION, Gaulin homogenizer, NANO3000, Nanomizer, or Microfluidizer, in the presence of the anionic surfactant.

Example 5 shows that aggregation of the resin particulates can be suppressed in forming the shell layers without the use of the aqueous medium dispersion liquid (Y) containing resin particulates stirred together with an anionic surfactant. Instead, Example 5 involves adding an anionic surfactant to the aqueous medium dispersion liquid (X) containing the toner cores, followed by mixing the aqueous medium dispersion liquid (X) and the aqueous medium dispersion liquid (Y) and stirring the resulting mixture liquid. The advantageous effect is still obtained as desired, presumably because the resin particulates are stirred together with the anionic surfactant when the aqueous medium dispersion liquid (X) and the aqueous medium dispersion liquid (Y) are stirred.

Comparative Examples 1 and 2 show that aggregation of the resin particulates for forming the shell layers may not be duly suppressed when the mixture liquid of the dispersion liquid of the toner cores and the dispersion liquid of the resin particulates is stirred together without a dispersant or with a dispersant other than an anionic surfactant.

What is claimed is:

1. A method for manufacturing an electrostatic latent image developing toner, comprising:

mixing an aqueous medium dispersion liquid (X) containing negatively chargeable toner cores and an aqueous medium dispersion liquid (Y) containing positively chargeable resin particulates including a quaternary ammonium functional group; and forming shell layers each on a surface of the toner cores with the resin particulates, wherein the aqueous medium dispersion liquid (X) or the aqueous medium dispersion liquid (Y) is subjected to a stirring treatment together with an anionic surfactant, and the aqueous medium dispersion liquid (Y) contains resin particulates subjected to the stirring treatment together with the anionic surfactant.

2. A method for manufacturing an electrostatic latent image developing toner according to claim 1, wherein an amount of the anionic surfactant in the aqueous medium dispersion liquid (Y) is 2% by mass or more and 10% by mass or less.

3. A method for manufacturing an electrostatic latent image developing toner, comprising:

mixing an aqueous medium dispersion liquid (X) containing negatively chargeable toner cores and an aqueous medium dispersion liquid (Y) containing positively chargeable resin particulates including a quaternary ammonium functional group; and forming shell layers each on a surface of the toner cores with the resin particulates, wherein the aqueous medium dispersion liquid (X) or the aqueous medium dispersion liquid (Y) is subjected to a stiffing treatment together with an anionic surfactant, and the aqueous medium dispersion liquid (Y) is subjected to a mixing treatment in the presence of the anionic surfactant by using a mixer.

4. A method for manufacturing an electrostatic latent image developing toner according to claim 3, wherein the aqueous medium dispersion liquid (Y) after the mixing treatment has a zeta-potential of −20 mV or less and −70 mV or more.

5. A method for manufacturing an electrostatic latent image developing toner according to claim 1, the resin particulates are formed of at least one resin selected from the group consisting of styrene-based resins having a quaternary ammonium salt, acrylic resins having a quaternary ammonium salt, styrene-acrylic resins having a quaternary ammonium salt, and polyester resins having a quaternary ammonium salt.

6. A method for manufacturing an electrostatic latent image developing toner according to claim 3, the resin particulates are formed of at least one resin selected from the group consisting of styrene-based resins having a quaternary ammonium salt, acrylic resins having a quaternary ammonium salt, styrene-acrylic resins having a quaternary ammonium salt, and polyester resins having a quaternary ammonium salt.

* * * * *